US011808122B2

(12) United States Patent
Artinian et al.

(10) Patent No.: US 11,808,122 B2
(45) Date of Patent: Nov. 7, 2023

(54) DEPLOYING A DOWNHOLE SAFETY VALVE WITH AN ARTIFICIAL LIFT SYSTEM

(71) Applicant: Upwing Energy, Inc., Cerritos, CA (US)

(72) Inventors: Herman Artinian, Huntington Beach, CA (US); David Biddick, Houston, TX (US); Cole Young, Cerritos, CA (US)

(73) Assignee: Upwing Energy, Inc., Cerritos, CA (US)

( * ) Notice: Subject to any disclaimer, the term of this patent is extended or adjusted under 35 U.S.C. 154(b) by 0 days.

(21) Appl. No.: 17/661,692

(22) Filed: May 2, 2022

(65) Prior Publication Data

US 2023/0279753 A1 Sep. 7, 2023

Related U.S. Application Data

(60) Provisional application No. 63/268,960, filed on Mar. 7, 2022.

(51) Int. Cl.

| | |
|---|---|
| ***E21B 43/12*** | (2006.01) |
| ***E21B 31/00*** | (2006.01) |
| ***E21B 33/12*** | (2006.01) |
| ***E21B 34/06*** | (2006.01) |

(52) U.S. Cl.

CPC ..... *E21B 43/128* (2013.01); *E21B 31/00* (2013.01); *E21B 33/12* (2013.01); *E21B 34/06* (2013.01); *E21B 2200/05* (2020.05)

(58) Field of Classification Search

CPC ..... E21B 43/128; E21B 31/00; E21B 33/12; E21B 34/06; E21B 2200/05

See application file for complete search history.

(56) References Cited

U.S. PATENT DOCUMENTS 3,771,603 A * 11/1973 Crowe ..... E21B 23/06 166/322
4,121,659 A 10/1978 Taylor
4,625,798 A 12/1986 Bayh, III
(Continued)

FOREIGN PATENT DOCUMENTS

GB 2362901 12/2001
GB 2501352 10/2013
WO WO-2012045771 A2 * 4/2012 ..... E21B 33/072

OTHER PUBLICATIONS

Di Tullio et al., "Downhole Gas Compression: World's First Installation of a New Artificial Lifting Systems for Gas Wells"; Society of Petroleum Engineers; SPE 12185; Jun. 8, 2009, 17 pages.
(Continued)

*Primary Examiner* — Steven A MacDonald
(74) *Attorney, Agent, or Firm* — Fish & Richardson P.C.

(57) ABSTRACT

A fluid end is coupled to and configured to be driven by an electric motor. A shear interconnect is at an uphole end of the electric submersible pump. The shear interconnect is configured to shear a cable line between the electric submersible pump and a topside facility. The shear interconnect is configured to shear the cable at the electric submersible pump. A safety valve is arranged to cease flow within a wellbore, in which the electric submersible pump is installed, when the safety valve is in a closed position.

14 Claims, 10 Drawing Sheets

(56) References Cited

U.S. PATENT DOCUMENTS 4,678,035 A * 7/1987 Goldschild ..... E21B 49/087 166/240
4,913,239 A * 4/1990 Bayh, III ..... E21B 23/14 166/66.4
5,193,614 A * 3/1993 Cox ..... E21B 17/028 166/65.1
5,265,682 A 11/1993 Russell et al.
5,404,946 A 4/1995 Hess
5,836,394 A 11/1998 Blank
6,398,583 B1 * 6/2002 Zehren ..... H01R 24/58 439/205
8,807,970 B2 8/2014 Schlenhoff
8,985,226 B2 * 3/2015 Head ..... E21B 17/10 166/107
10,253,606 B1 * 4/2019 Artinian ..... E21B 41/02
10,337,557 B1 * 7/2019 McMullen ..... H02K 7/09
10,428,822 B1 * 10/2019 Wang ..... E21B 4/003
2003/0132003 A1 * 7/2003 Arauz ..... F04D 13/024 166/66.5
2003/0145989 A1 * 8/2003 Shaw ..... E21B 43/128 166/265
2008/0080991 A1 * 4/2008 Yuratich ..... F04B 47/06 417/415
2010/0258306 A1 * 10/2010 Camilleri ..... E21B 43/128 166/265
2011/0005772 A1 * 1/2011 Ceccarelli ..... E21B 33/10 166/372
2011/0011596 A1 * 1/2011 Martinez ..... E21B 17/028 166/372
2012/0024543 A1 * 2/2012 Head ..... E21B 17/10 166/77.51
2012/0031624 A1 * 2/2012 Goughnour ..... E21B 34/14 166/373
2012/0199367 A1 * 8/2012 Bouldin ..... E21B 43/128 166/332.8
2012/0211240 A1 * 8/2012 Xiao ..... E21B 17/18 166/372
2013/0043034 A1 2/2013 Drablier et al.
2013/0098632 A1 * 4/2013 Wetzel ..... E21B 33/072 166/85.1
2013/0206389 A1 * 8/2013 Vick, Jr. ..... E21B 43/128 166/105
2015/0114632 A1 4/2015 Romer et al.
2016/0024899 A1 1/2016 Lynn
2016/0060973 A1 3/2016 Nkwocha
2017/0241259 A1 8/2017 White et al.
2017/0370174 A1 12/2017 Yun et al.
2018/0041081 A1 2/2018 Canini
2018/0041086 A1 2/2018 Madbouly et al.
2018/0163526 A1 * 6/2018 Chidi ..... E21B 43/128
2018/0171766 A1 * 6/2018 Clingman ..... F04D 13/10
2018/0171767 A1 * 6/2018 Huynh ..... F04D 13/10
2018/0179870 A1 6/2018 Artinian
2018/0363431 A1 12/2018 Crowley et al.
2019/0264553 A1 * 8/2019 Garces ..... E21B 43/38
2019/0390538 A1 * 12/2019 Frantz, III ..... E21B 47/008
2020/0048988 A1 * 2/2020 Vick, Jr. ..... E21B 43/12

OTHER PUBLICATIONS

Hossain et al., "Potential Application of Downhole Gas Compressor to Improve Productivity for Gas Reservoir"; International Petroleum Technology Conference; IPTC 16982; Mar. 26, 2013, 13 pages.

International Search Report and Written Opinion in International Appln. No. PCT/US2023/014631, dated May 8, 2023, 14 pages.

* cited by examiner

DEPLOYING A DOWNHOLE SAFETY VALVE WITH AN ARTIFICIAL LIFT SYSTEM

CROSS-REFERENCE TO RELATED PATENT APPLICATIONS

This application claims the benefit of priority U.S. Provisional Application No. 63/268,960, filed Mar. 7, 2022, the contents of which are incorporated by reference herein.

TECHNICAL FIELD

This disclosure relates to downhole safety valves and artificial lift system.

BACKGROUND

Most wells behave characteristically different over time due to geophysical, physical, and chemical changes in the subterranean reservoir that feeds the well. For example, it is common for well production to decline. This decline in production can occur due to declining pressures in the reservoir, and can eventually reach a point where there is not enough pressure in the reservoir to economically realize production through the well to the surface. Downhole pumps and/or compressors can be deployed into the well to increase production. Additionally or alternatively, a topside compressor and/or pump are sometimes used to extend the life of the well by decreasing pressure at the top of the well.

SUMMARY

This disclosure relates to deploying a downhole safety valve with an artificial lift system.

An example implementation of the subject matter described within this disclosure is an electric submersible artificial lift system with the following features. A fluid end is coupled to and configured to be driven by an electric motor. A shear interconnect is at an uphole end of the electric submersible artificial lift system. The shear interconnect is configured to shear a cable extending between the electric submersible artificial lift system and a topside facility. The shear interconnect is configured to shear the cable at the electric submersible artificial lift system. A safety valve is arranged to cease flow within a wellbore, in which the electric submersible artificial lift system is installed, when the safety valve is in a closed position.

Aspects of the example electric submersible artificial lift system, which can be combined with the electric submersible artificial lift system alone or with other aspects, include the following. The electric submersible artificial lift system is configured to be stabbed into and seal with a downhole receptacle.

Aspects of the example electric submersible artificial lift system, which can be combined with the electric submersible artificial lift system alone or with other aspects, include the following. A shroud encapsulates the electric motor and the fluid end. The shroud is configured to be stabbed into the downhole receptacle.

Aspects of the example electric submersible artificial lift system, which can be combined with the electric submersible artificial lift system alone or with other aspects, include the following. The safety valve includes a flapper valve biased towards a closed position.

Aspects of the example electric submersible artificial lift system, which can be combined with the electric submersible artificial lift system alone or with other aspects, include the following. The electric motor and the fluid end are coupled together by a magnetic coupling.

Aspects of the example electric submersible artificial lift system, which can be combined with the electric submersible artificial lift system alone or with other aspects, include the following. The safety valve is at an uphole end of the fluid end.

Aspects of the example electric submersible artificial lift system, which can be combined with the electric submersible artificial lift system alone or with other aspects, include the following. The safety valve is downhole of the fluid end.

Aspects of the example electric submersible artificial lift system, which can be combined with the electric submersible artificial lift system alone or with other aspects, include the following. The safety valve is integrated into the electric submersible artificial lift system.

Aspects of the example electric submersible artificial lift system, which can be combined with the electric submersible artificial lift system alone or with other aspects, include the following. The electric motor is uphole of the fluid end.

An example implementation of the subject matter described within this disclosure is a method with the following features. An electric submersible artificial lift system is received by a packer that includes a receptacle configured to receive the electric submersible artificial lift system. A safety valve is received by the packer.

Aspects of the example method, which can be combined with the example method alone or with other aspects, include the following. The packer includes a latch. The method further includes securing, by the latch, the electric submersible artificial lift system to the packer.

Aspects of the example method, which can be combined with the example method alone or with other aspects, include the following. The electric submersible artificial lift system is released by the latch.

Aspects of the example method, which can be combined with the example method alone or with other aspects, include the following. Releasing the electric submersible artificial lift system includes receiving a fishing tool by the electric submersible artificial lift system.

Aspects of the example method, which can be combined with the example method alone or with other aspects, include the following. The electric submersible artificial lift system is over-pulled or jarred by the fishing tool. The latch released the electric submersible artificial lift system responsive to the over-pull or jar.

Aspects of the example method, which can be combined with the example method alone or with other aspects, include the following. The safety valve is left within a wellbore with the packer.

Aspects of the example method, which can be combined with the example method alone or with other aspects, include the following. A cable at an uphole end of the electric submersible artificial lift system is sheared.

An example implementation of the subject matter described within this disclosure is a wellbore system with the following features. A cable extends into a wellbore from a topside facility. The cable includes electrical lines, hydraulic lines, and a support structure configured to support tooling at a downhole end of the cable. An electric submersible artificial lift system is at the downhole end of the cable. The electric submersible artificial lift system includes the following features. A fluid end is coupled to and configured to be driven by an electric motor. A shear interconnect is at an uphole end of the electric submersible artificial lift system. The shear interconnect is configured to shear a cable between the electric submersible artificial lift system and the topside facility. The shear interconnect configured to shear the cable at the electric submersible artificial lift system. A packer defines a receptacle configured to receive the electric submersible artificial lift system. A safety valve is arranged to cease flow within a wellbore, in which the electric submersible artificial lift system is installed, when the safety valve is in a closed position.

Aspects of the example wellbore system, which can be combined with the example wellbore system alone or with other aspects, include the following. The hydraulic line is configured to actuate the safety valve and inject chemicals into a production stream.

Aspects of the example wellbore system, which can be combined with the example wellbore system alone or with other aspects, include the following. The hydraulic line is configured to deliver lubrication to the electric submersible artificial lift system and actuate the safety valve.

Aspects of the example wellbore system, which can be combined with the example wellbore system alone or with other aspects, include the following. The safety valve is integrated with the electric submersible artificial lift system.

Aspects of the example wellbore system, which can be combined with the example wellbore system alone or with other aspects, include the following. A mechanical shifting tool is configured to actuate an isolation barrier within the receptacle. The isolation barrier is biased towards a closed position. The mechanical shifting tool is configured to move the isolation barrier to an open position once the electric submersible artificial lift system and safety valve are received by the receptacle.

Aspects of the example wellbore system, which can be combined with the example wellbore system alone or with other aspects, include the following. The safety valve is integrated into the packer.

Aspects of the example wellbore system, which can be combined with the example wellbore system alone or with other aspects, include the following. The packer includes a latch configured to secure the electric submersible artificial lift system.

Aspects of the example wellbore system, which can be combined with the example wellbore system alone or with other aspects, include the following. A balance line is fluidically arranged to transfer pressure from a portion of the wellbore downhole of the valve to the safety valve. Pressure from the balance line reduces a force needed to actuate the safety valve.

Aspects of the example wellbore system, which can be combined with the example wellbore system alone or with other aspects, include the following. A pressurized canister provides pressure to the safety valve. The pressure from the pressurized canister reduces a force needed to actuate the safety valve.

Aspects of the example wellbore system, which can be combined with the example wellbore system alone or with other aspects, include the following. The safety valve is an electric safety valve coupled to a power system of the electric submersible artificial lift system. The electric safety valve is configured to operate responsive to power provided to the electric submersible artificial lift system.

The details of one or more implementations of the subject matter described within this disclosure are set forth in the accompanying drawings and the description below. Other features, objects, and advantages of the subject matter described herein will be apparent from the description and drawings, and from the claims.

DESCRIPTION OF DRAWINGS

Like reference symbols in the various drawings indicate like elements.

DETAILED DESCRIPTION

This disclosure describes an artificial lift arrangement that allows for easy retrieval and repair of artificial lift systems, such as electric submersible pumps, and downhole safety valves. The implementations described herein include an electric submersible pump, a downhole safety valve, and a receptacle configured to receive and retain the electric submersible pump. The safety valve is integrated with the electric submersible pump or the receptacle. The electric submersible pump is coupled to a wellhead or other topside equipment by a cable that includes electrical and/or hydraulic lines. The electric and/or hydraulic lines power and control the electric submersible pump and/or the safety valve.

Figure 1A:
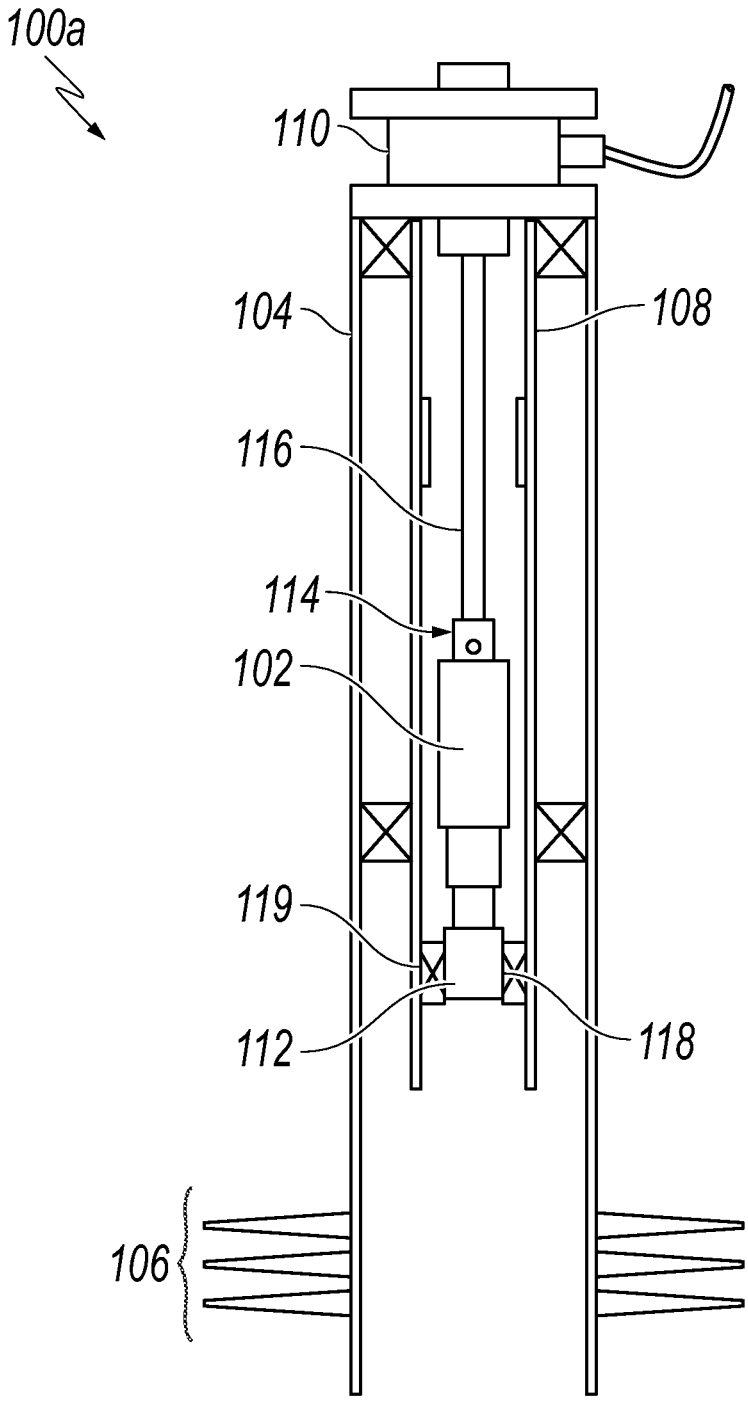
FIG. 1A is a side cross-sectional diagram of an example downhole artificial lift arrangement.

FIG. 1A is a side cross-sectional diagram of an example downhole artificial lift arrangement 100*a*. The artificial lift arrangement 100*a* includes an electric submersible pump 102 within a wellbore 104. During operation, the electric submersible pump 102 assists in flowing production fluid from a production zone 106, up through production tubing 108, to a topside facility, such as a wellhead 110. In some implementations, the topside facility includes a subsea wellhead. While this disclosure primarily describes implementations using electric submersible pumps, other downhole artificial lift systems, such as electric submersible compressors, top-driven pumps or compressors, plunger pumps and compressors, and gerotor pumps can be used without departing from this disclosure. Other mechanical lift devices, including positive displacement and centrifugal fluid movers, can be used without departing from this disclosure.

The electric submersible pump 102 includes an integrated safety valve 112 configured to cease fluid flow through the wellbore 104 when the safety valve 112 is in the closed position. While the illustrated implementation shows the safety valve to be at a downhole end of the electric submersible pump 102, other arrangements are possible without departing from this disclosure. More details on various implementations or the safety valve 112 are described throughout this disclosure.

In some instances, such as during deployment, the cable supports the electric submersible pump. The cable includes electric and/or hydraulic lines 116 as well as any structural components to ensure the cable supports the weight of the electric submersible pump 102. The cable includes a smooth outer surface such that the cable can be fed through a lubricator or similar structure. At an uphole end of the electric submersible pump 102 is a shear interconnect 114. The shear interconnect 114 allows for an cable with electric and/or hydraulic lines 116 and structural components, extending between the wellhead 110 and the electric submersible pump 102, to be sheared at an uphole end of the electric submersible pump 102. That is, the electric and/or hydraulic lines 116 are sheared at the shear interconnect 114 such that the electric and/or hydraulic lines 116 can be removed completely or nearly completely from the wellbore while the electric submersible pump 102 remains within the wellbore 104. The shear interconnect 114 initiates a shearing action when the electric and/or hydraulic lines 116 experience an over-pull scenario. That is, the shearing action occurs when tension within the electric and/or hydraulic lines exceeds a specified threshold. Typically, the tension is increased by pulling an uphole end of the electric and/or hydraulic lines 116 in an uphole direction at the wellhead 110. While primarily described within this disclosure as decoupling by a shearing action, other disconnection mechanisms can be used to disconnect the cable from the electric submersible pump without departing from this disclosure. For example, a hydraulically controlled cable release system can be used. Such an implementation includes a latching mechanism to secure and retain the cable to the electric submersible pump, and a signal (e.g. hydraulic, pneumatic, or electric) is used to actuate the latch to a secure position or a release position.

The electric submersible pump 102 is stabbed into a downhole receptacle 118. The downhole receptacle 118 can include a polished bore receptacle, a packer configured to receive the electric submersible pump, or any other receptacle that is appropriate for the operations described herein. The electric submersible pump 102 and the downhole receptacle 118 seal against one another when the electric submersible pump is fully received by the downhole receptacle 118. That is, fluid flows primarily through the downhole receptacle 118 and electric submersible pump 102 with little-to-no leakage past the seals (shown in later figures). In some implementations, the downhole receptacle 118 includes a latch configured to secure and retain the electric submersible pump 102 within the downhole receptacle 118. Such latches are described in greater detail later within this disclosure. In implementations where the safety valve 112 is integrated into the downhole end of the electric submersible pump, the safety valve 112 is the portion of the electric submersible pump stabbed into and received by the downhole receptacle 118.

Figure 1B:
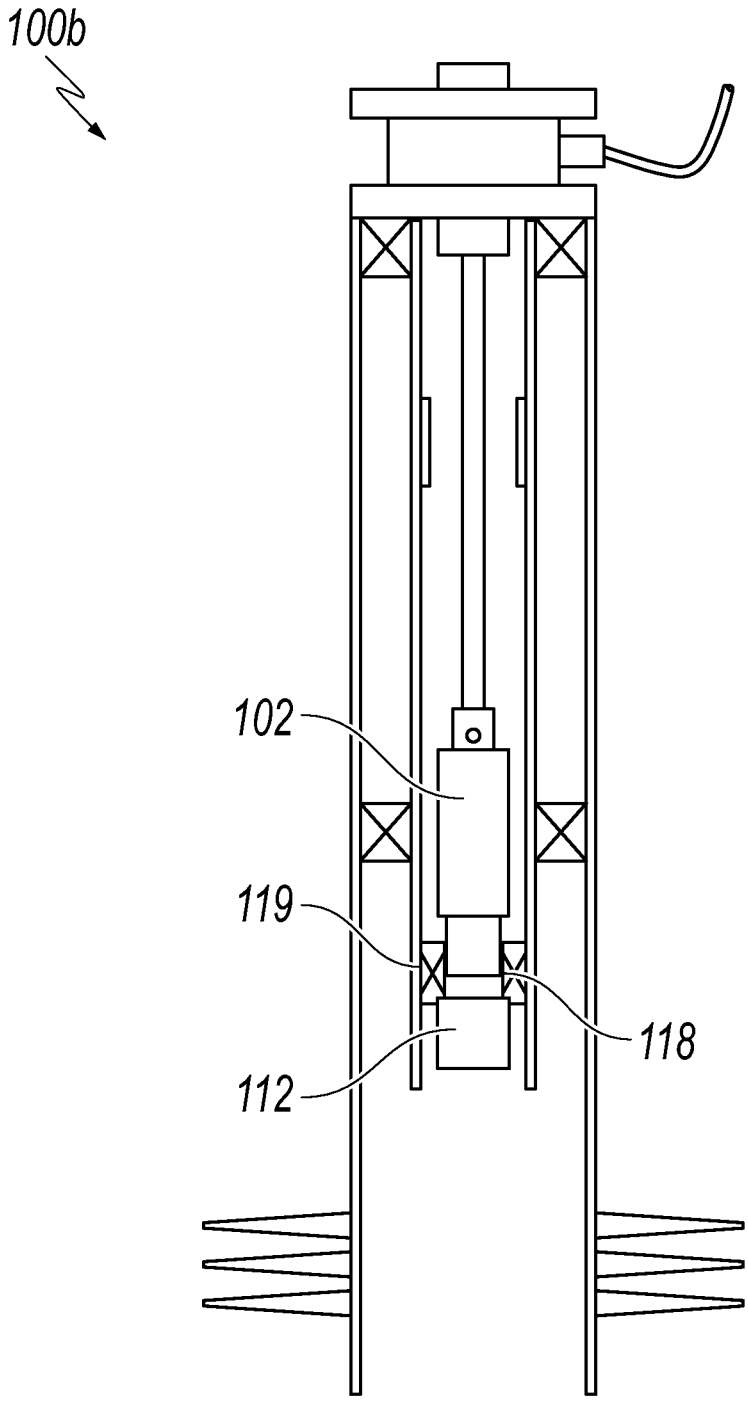
FIG. 1B is a side cross-sectional diagram of an example downhole artificial lift arrangement.

FIG. 1B is a side cross-sectional diagram of an example downhole artificial lift arrangement 100*b*. The artificial lift arrangement 100*b* is substantially similar to the artificial lift arrangement 100*a* with the exception of any differences described herein. A safety valve 112 is integrated into the downhole receptacle 118. The safety valve 112 is biased in the closed position when the electric submersible pump 102 is out of the downhole receptacle 118. In this implementation, the electric submersible pump is directly stabbed into the downhole receptacle 118.

Figure 2A:
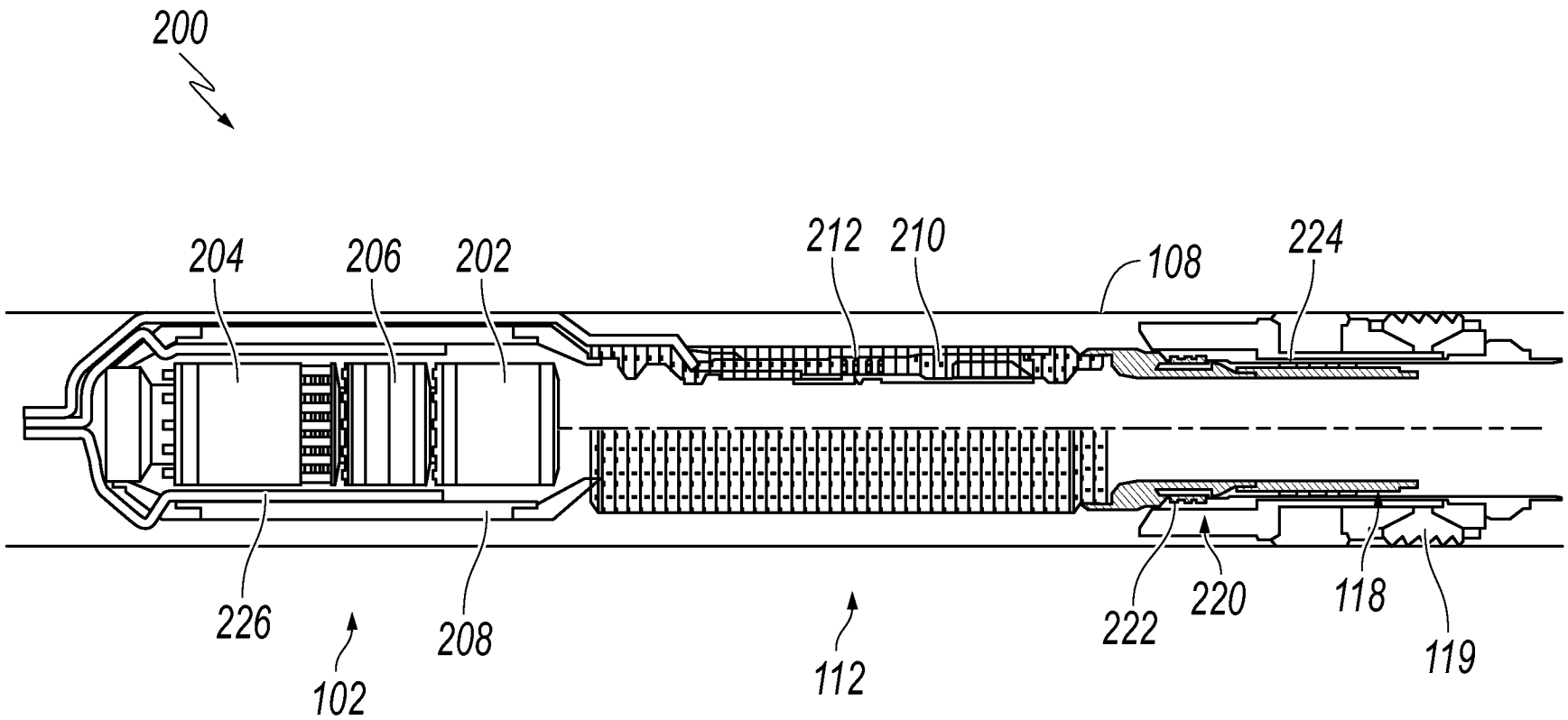
FIG. 2A is a side cross-sectional view of an example electrical submersible pump and safety valve arrangement.

FIG. 2A is a side cross-sectional view of an example electrical submersible pump and safety valve arrangement 200. The electrical submersible pump and safety valve arrangement 200 share similar components and arrangements to the artificial lift arrangement 100*a*, and, in some instances, can be used within the artificial lift arrangement 100*a*. The electrical submersible pump and safety valve arrangement 200 includes the electric submersible pump 102. The electric submersible pump 102 includes an electric motor 202 coupled to a fluid end 204 by a coupling 206. The fluid end 204 is configured to be driven by the electric motor 202. In some implementations, the coupling 206 includes a magnetic coupling or a direct-drive coupling.

The electric submersible pump 102 includes a shroud 208 encapsulating the electric motor 202, the coupling 206, and the fluid end 204. At a downhole end of the shroud 208 is the safety valve 112. The safety valve 112 includes a flapper 210 biased to close in the uphole direction, for example, by a spring 212. The flapper 210 is actuated towards the open position by a sleeve 214 along an inner surface of a flow passage defined by the safety valve 112. The sleeve 214 can be moved in a downhole direction to open the flapper in a variety of ways.

For example, a hydraulic line 216 from a topside facility that can apply pressure to a piston 218 to overcome the bias and open the flapper by moving the sleeve In some implementations, the hydraulic line 216 used to operate the safety valve 112 is also used for chemical injection. For example, when pressure is provided to the hydraulic line 216 at a first specified pressure, the safety valve is opened in response to the provided pressure. In some implementations, when pressure is provided a second specified pressure, greater than the first specified pressure, fluid is injected into the production fluid while holding the valve open. In some implementations, such an arrangement is sued to inject scale inhibitor, wax inhibitor, scale inhibitor, or hydrate inhibitor. Other chemicals can be injected without departing from this disclosure. Alternatively or in addition, in some implementations, the hydraulic line 216 is used to provide lubricant to the electric submersible pump and to provide pressure to actuate the safety valve 112.

In some implementations, the safety valve 112 is mechanically operated, for example, by a linkage that moves the flapper to the open position when the electric submersible pump 102 is stabbed into the downhole receptacle 118. In some implementations, the safety valve 112 is an electric safety valve coupled to a power system (e.g. electrical lines 226, windings of the electric motor, or onboard control circuitry) of the electric submersible pump 102. In such implementations, the electric safety valve is configured to operate responsive to power provided to the electric submersible pump 102. For example, when the electric submersible pump is running, the electric safety valve opens in response.

Figure 2C:
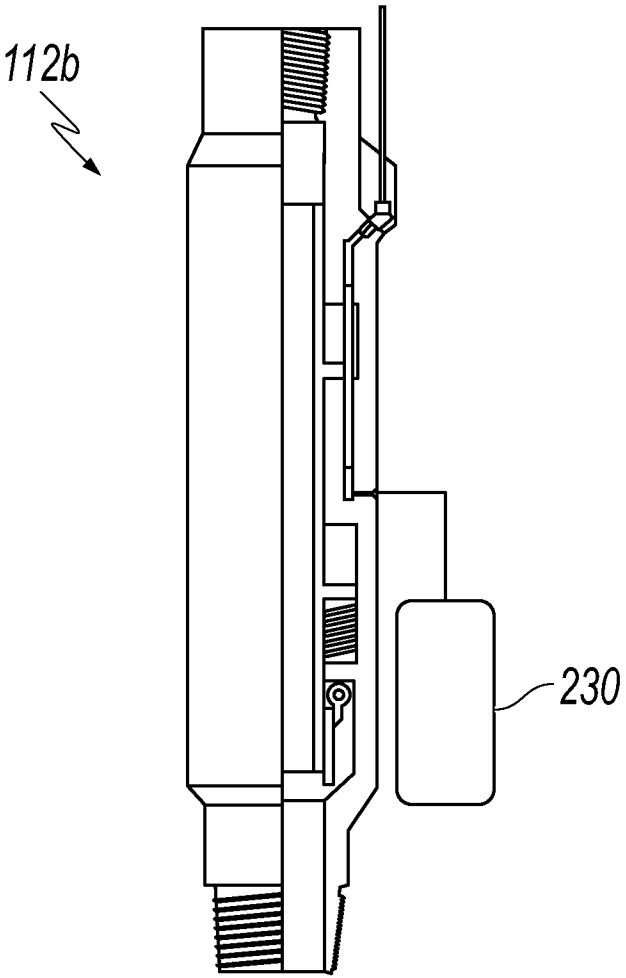
FIGS. 2B and 2C are quarter cross-sectional views of example safety valves.
Figure 2B:
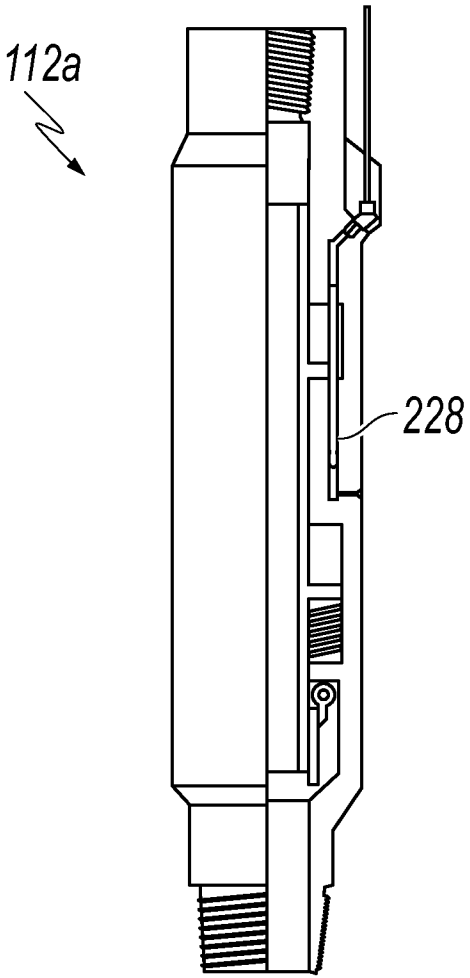

FIGS. 2B and 2C are quarter cross-sectional views of example safety valves 112*a* and 112*b*. The safety valves 112*a* and 112*b* are substantially similar to safety valve 112, with the exception of any difference described herein, and can be used in lieu of safety valve 112 in any of the implementations described herein. In some implantations, a balance line 228 is fluidically arranged to transfer pressure from a portion of the wellbore downhole of the valve to the safety valve 112 to the safety valve actuation systems. Pressure from the balance line reduces a force needed to actuate the safety valve 112. Alternatively or in addition, a pressurized canister 230 is included downhole near the safety valve 112. The pressurized canister 230 provides pressure to the safety valve such that the pressure from the pressurized canister 230 reduces a force needed to actuate the safety valve 112. Multiple types of compressed gas can be used, for example, compressed air, hydrocarbons, nitrogen, or carbon dioxide can be used. Other compressed gasses can be used without departing from this disclosure.

While primarily described and illustrated as a flapper 210, other valve configurations can be used without departing from this disclosure. For example, a poppet style safety valve or a sliding sleeve safety valve can be used with similar bias and control mechanisms without departing from this disclosure. In some implementations, a temporary lock-out is included with the safety valve 112. Such a lockout is used to keep the valve open during installation to allow the well to flow during installation. Once installed, the lock-out can be sheared, dissolved, or otherwise removed for standard operations.

In some implementations, the downhole receptacle 118 includes a latch 220 configured to retain or secure the electric submersible pump 102 within the downhole receptacle 118. For example, collets 222 within the latch 220 include profiles that are configured to engage and mate with corresponding profiles on the electric submersible pump 102. Such a latch can be hydraulically, mechanically, or electrically actuated without departing from this disclosure. In some implementations, the latch is integrated and retrievable with the electric submersible pump 102. In some implementations, the latch is integrated and retrievable with the packer 119.

In some implementations, the downhole receptacle 118 is a polished bore receptacle. In such an implementation, the electric submersible pump 102 includes annular seals 224 that seat against an inner wall of the downhole receptacle 118. In some implementations, such seals can be included within the downhole receptacle 118 and seat against the electric submersible pump 102.

Figure 3A:
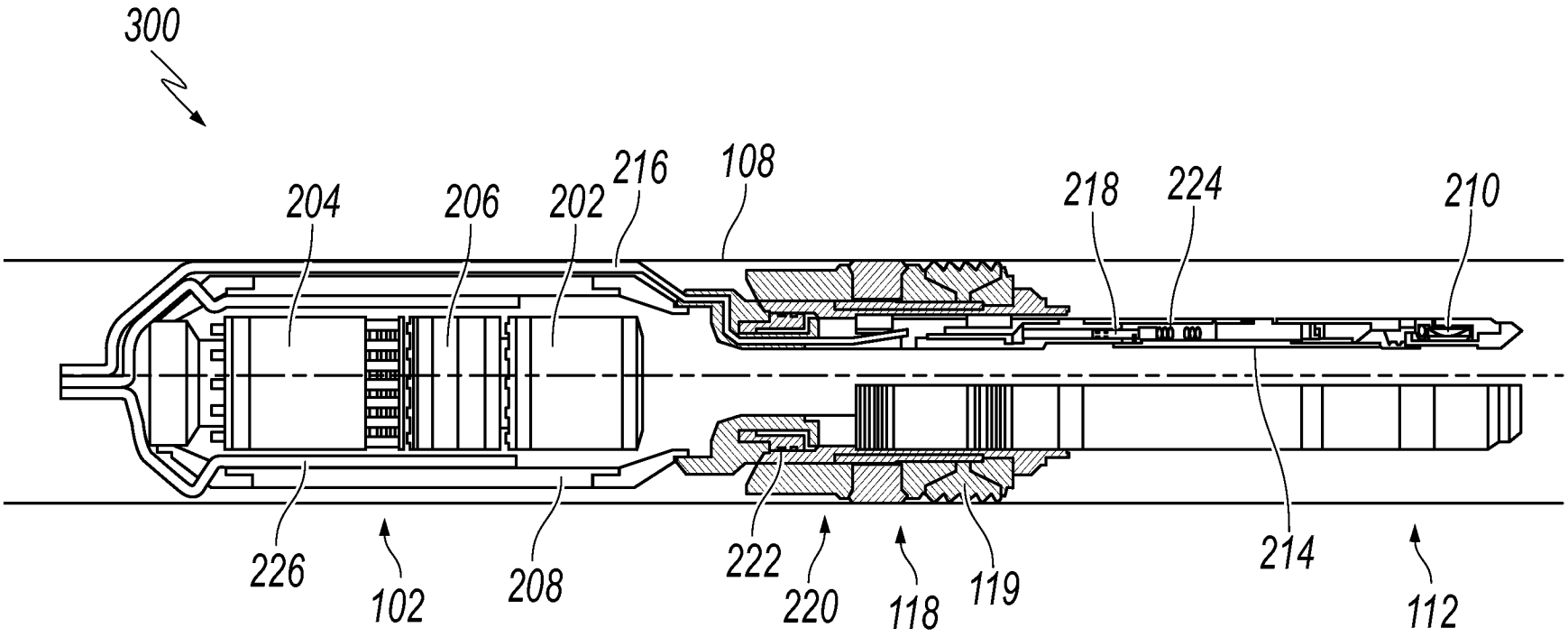
FIG. 3A is a side cross-sectional view of an example electrical submersible pump and safety valve arrangement.

FIG. 3A is a side cross-sectional view of an example electrical submersible pump and safety valve arrangement 300. The electrical submersible pump and safety valve arrangement 300 shares similar components and arrangements to the artificial lift arrangement 100*b*, and, in some instances, can be used within the artificial lift arrangement 100*b*. The electrical submersible pump and safety valve arrangement 300 is substantially similar to the electric submersible pump and safety valve arrangement 200 with the exception of any differences described or illustrated herein.

In this implementation, the safety valve 112 is integrated into the downhole receptacle 118. As such, the shroud 208 of the electric submersible pump 102 is stabbed directly into the downhole receptacle 118. In some implementations, the electric submersible pump 102 includes a hydraulic line that operates the safety valve 112 once the electric submersible pump 102 is stabbed into the downhole receptacle 118. In such implementations, a hydraulic connection is made by the stabbing process. In some implementations, such a hydraulic connection requires a clocking feature to align the electric submersible pump portion of the hydraulic connection and the receptacle portion of the hydraulic connection. In some implementations, the hydraulic connection can include an annular hydraulic connection that does not require a clocking mechanism.

Figure 3B:
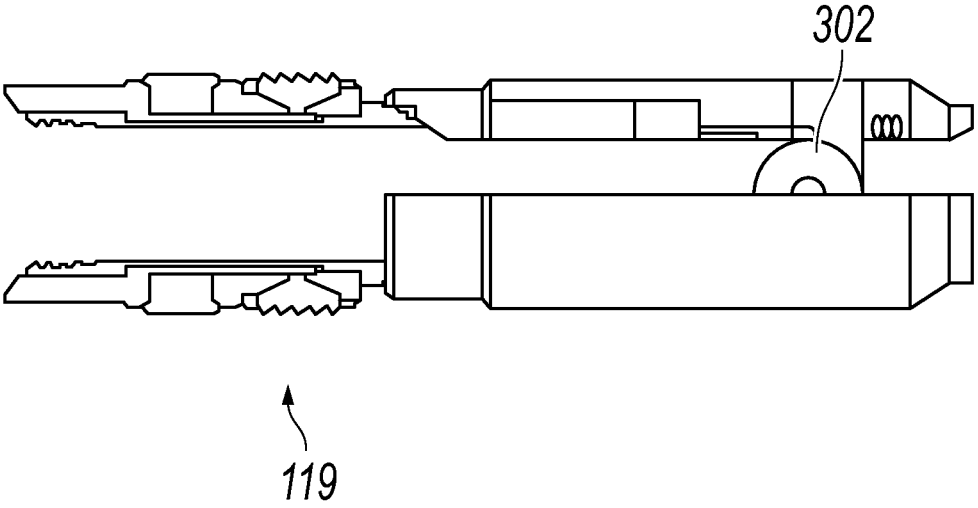
FIGS. 3B-3D are side cross-sectional diagrams of example packer and receptacle arrangements that can be used with aspects of this disclosure.
Figure 3C:
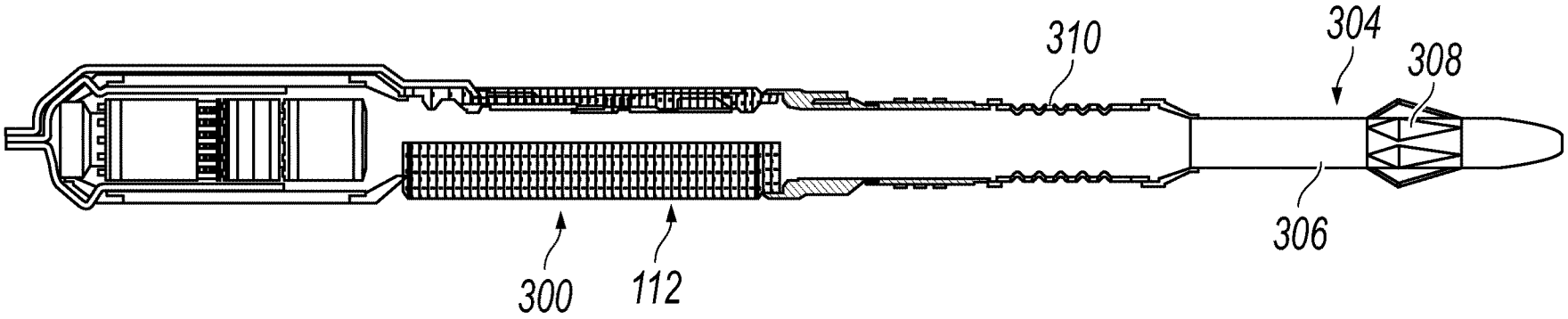
Figure 3D:
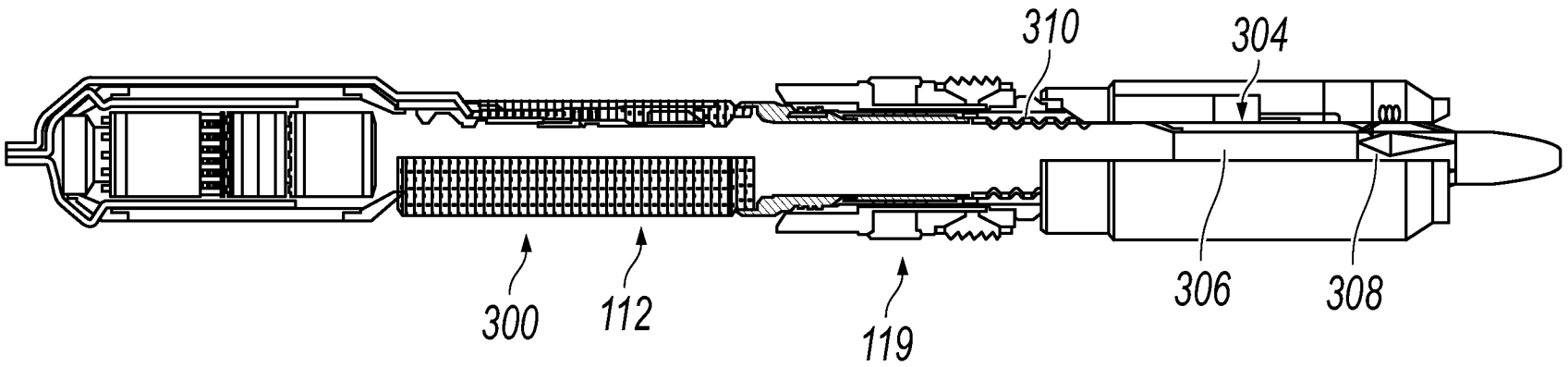

FIGS. 3B-3D are side cross-sectional diagrams of example packer and receptacle arrangements that can be used with aspects of this disclosure. In some implementations, the packer 119 includes an isolation barrier 302. During installation of the packer 119, in some implementations, the packer 119 is run with the isolation barrier 302 in an open position. Once the packer is installed, the isolation barrier 302 is then closed either responsive to the packer being set or by an independent slickline run. In such implementations, a mechanical shifting tool 304 is included at a downhole end of the safety valve 112 and/or the electric submersible pump 102 (whichever is more downhole upon the package). The mechanical shifting tool 304 is configured to actuate the isolation barrier. When the safety valve 112 or electric submersible pump 102 are stung into the packer 119, the isolation valve is opened, for example, by the mechanical shifting tool 304, until the safety valve 112 and/or electric submersible pump 102 are removed from the packer 119. The mechanical shifting tool 304 is shaped such as to allow fluid flow around or through the mechanical shifting tool 304. For example, in the illustrated implementations, the mechanical shifting tool 304 includes a central body 306 with centralizers 308. Uphole of the central body 306 and centralizers 308 is a perforated section 310 that allows fluid flow into the flow passage defined by the safety valve 112. Such an arrangement allows for actuation of the isolation barrier 302 while maintaining production fluid flow. Other arrangements are feasible without departing from this disclosure. For example, in some implementations, the mechanical shifting tool 304 defines an inlet and flow passage. While primarily illustrated and described with relation to the safety valve arrangement 300, the details illustrated and described in relation to FIGS. 3B-3D can be applied to any of the arrangements described within this disclosure.

Figure 4:
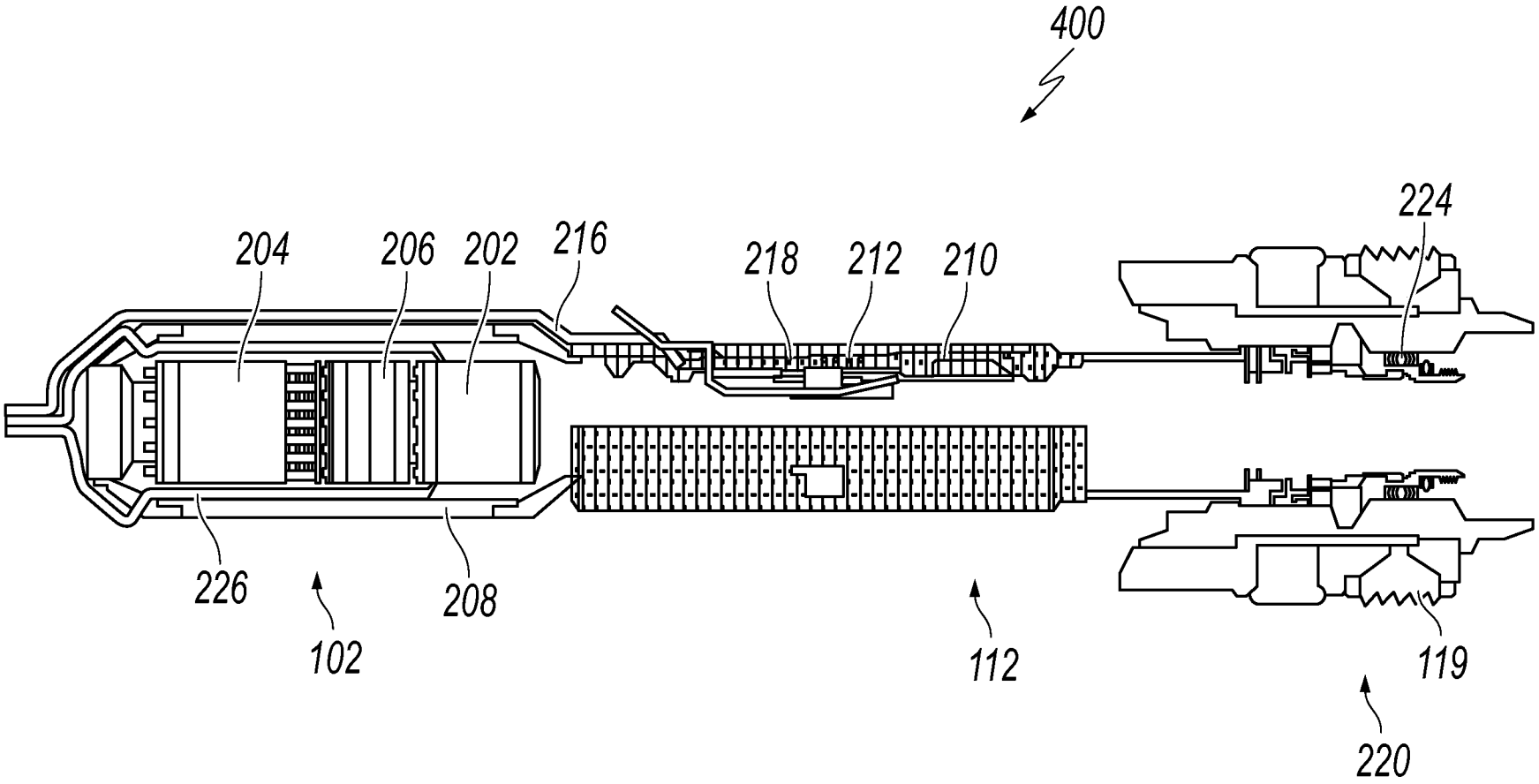
FIG. 4 is a side cross-sectional view of an example electrical submersible pump and safety valve arrangement.

FIG. 4 is a side cross-sectional view of an example electrical submersible pump and safety valve arrangement 400. The electrical submersible pump and safety valve arrangement 400 shares similar components and arrangements to the artificial lift arrangement 100*b*, and, in some instances, can be used within the artificial lift arrangement 100*b*. The electrical submersible pump and safety valve arrangement 400 is substantially similar to the electric submersible pump and safety valve arrangement 200 with the exception of any differences described or illustrated herein.

In the example electrical submersible pump and safety valve arrangement 400, the packer 119 includes a nipple profile 402. In operation, the safety valve 112 locks into the nipple profile 402 with a wetmate connection. That is, hydraulic and electrical connections are made downhole during installation. In implementations where the electric submersible pump 102 is not integrated with the safety valve 112, the electric submersible pump 102 then snaps into similar wetmate connection on the body of the safety valve 112. In some implementations, the wetmate connection includes circumferential seals and sealbores that allow communication to the safety valve 112. In some implementations, the wetmate connections include a male protrusion stabbing into a female recess where there is sealing elements on one or both and the position of the male or female could be on the safety valve 112 or the pump 102.

Also include the idea of the packer with the safety valve integral to the packer, such that there is a wetmate that the pump will connect with hydraulically or electrically. The pump snaps into the wetmate body in order to hold it in place.

Figure 5:
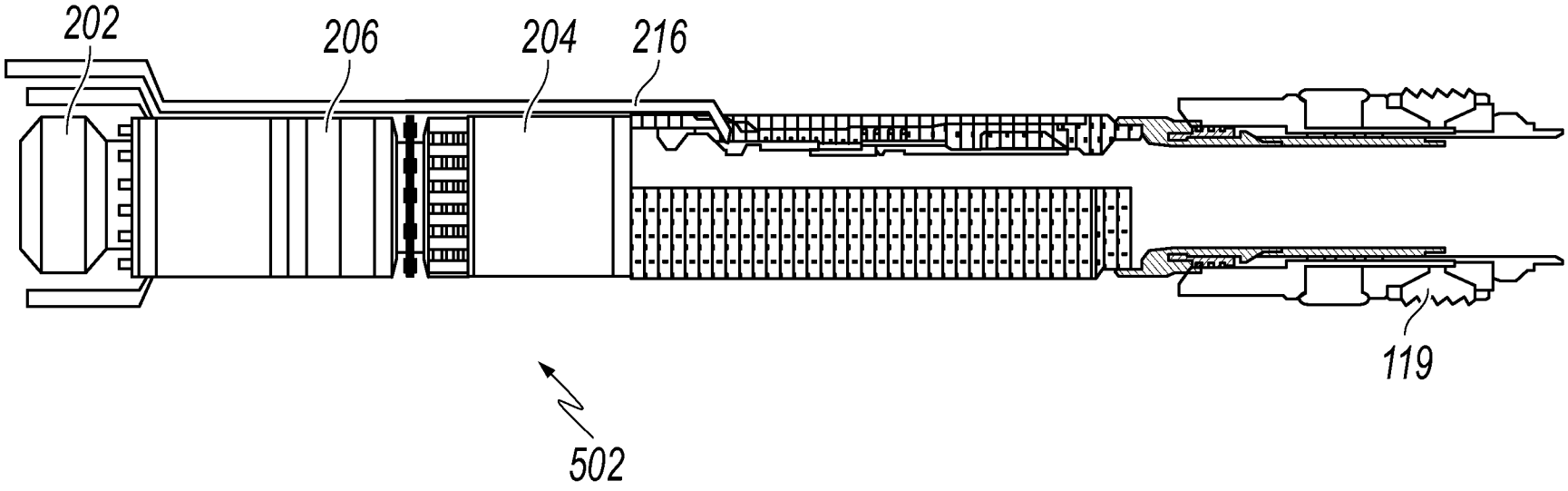
FIG. 5 is a side cross-sectional view of an example electrical submersible pump and safety valve arrangement.

FIG. 5 is a side cross-sectional view of an example electrical submersible pump and safety valve arrangement 500. The electrical submersible pump and safety valve arrangement 500 shares similar components and arrangements to the artificial lift arrangement 100*b*, and, in some instances, can be used within the artificial lift arrangement 100*b*. The electrical submersible pump and safety valve arrangement 500 is substantially similar to the electric submersible pump and safety valve arrangement 400 with the exception of any differences described or illustrated herein. The electrical submersible pump and safety valve arrangement 500 includes an inverted electric submersible pump 502. That is, the electric motor 202 is uphole of the fluid end 204. Such an arrangement is able to eliminate the shroud 208 (seen in FIG. 2) used in other implementations.

In an example operation, an electric submersible pump is received by a packer that includes a receptacle configured to receive the electric submersible pump. A safety valve is also received by the packer. In some implementations, the safety valve is received separately from the electric submersible pump. That is, the safety valve is integrated with the packer. In some implementations, the safety valve is received with the electric submersible pump. That is, the safety valve is integrated with the electric submersible pump.

In some implementations, the packer includes a latch. The electric submersible pump is secured to the packer by the latch. In some instances when the electric submersible pump is removed from the wellbore, the following steps are taken. An cable containing electrical and/or hydraulic lines is sheared at an uphole end of the electric submersible pump. The cable is sheared by a shearable interconnect at the electric submersible pump, and the shearable interconnect is triggered by an over-pull of the cable from the wellhead or topside facility. Once the cable is sheared, it is recovered from the wellbore. Once the cable is recovered, a fishing tool is received by the electric submersible pump. The fishing tool pulls up the electric submersible pump. In some implementations, the fishing tool performs an over-pull to release the electric submersible tool from the latch of the receptacle. In some implementations, a jarring tool is used to release the electric submersible tool from the latch of the receptacle. In some implementations, the latch has already been released prior to removing the electric submersible pump, for example, in implementations where the latch is hydraulically powered, the latch is released when the cable is sheared.

In implementations where the safety valve is integrated with the electric submersible pump, the fishing tool pulls the electric submersible pump and the safety valve out as a single unit. In implementations where the safety valve is integrated with the packer, the safety valve remains downhole with the packer once the electric submersible pump is removed.

While this disclosure has primarily describe electric submersible pumps, other downhole artificial lift systems, such as electric submersible compressors, top-driven pumps or compressors, plunger pumps and compressors, and gerotor pumps can be used without departing from this disclosure. Other mechanical lift devices, including positive displacement and centrifugal fluid movers, can be used without departing from this disclosure.

A number of implementations have been described. Nevertheless, it will be understood that various modifications may be made without departing from the spirit and scope of this disclosure. For example, the safety valve can be integrated with an uphole end of an electric submersible pump without departing from this disclosure. Accordingly, other implementations are within the scope of the following claims.

What is claimed is:

1. A wellbore system comprising:

a cable extending into a wellbore from a topside facility, the cable comprising electrical lines, hydraulic lines, and a support structure configured to support tooling at a downhole end of the cable;

an electric submersible artificial lift system at the downhole end of the cable, the electric submersible artificial lift system comprising:

an electric motor;

a fluid end coupled to and configured to be driven by the electric motor; and a shear interconnect at an uphole end of the electric submersible artificial lift system, the shear interconnect configured to shear the cable between the electric submersible artificial lift system and the topside facility, the shear interconnect configured to shear the cable at the electric submersible artificial lift system;

a packer defining a receptacle configured to receive the electric submersible artificial lift system; and a safety valve arranged to cease flow within the wellbore when the safety valve is in a closed position, wherein the hydraulic lines are configured to actuate the safety valve and inject chemicals into a production stream.

2. The wellbore system of claim 1, wherein the hydraulic lines are configured to deliver lubrication to the electric submersible artificial lift system.

3. The wellbore system of claim 1, wherein the packer comprises a latch configured to secure the electric submersible artificial lift system.

4. The wellbore system of claim 1, further comprising a balance line fluidically arranged to transfer pressure from a portion of the wellbore downhole of the valve to the safety valve, the balance line configured to provide pressure to reduce a force needed to actuate the safety valve.

5. The wellbore system of claim 1, wherein the safety valve is an electric safety valve coupled to a power system of the electric submersible artificial lift system, the electric safety valve configured to operate responsive to power provided to the electric submersible artificial lift system.

6. A method of using the wellbore system claim 1 comprising:

supporting, by the cable extending into the wellbore from the topside facility, the electric submersible artificial lift system;

receiving the electric submersible artificial lift system by the packer actuating, by the hydraulic lines, the safety valve;

injecting, by the hydraulic lines, chemicals into a production stream; and shearing, by the shear interconnect, the cable at the electric submersible artificial lift system.

7. The method of claim 6, wherein the packer comprises a latch, the method further comprising:

securing, by the latch, the electric submersible artificial lift system to the packer.

8. The method of claim 7, further comprising:

releasing, by the latch, the electric submersible artificial lift system.

9. The method of claim 8, wherein releasing the electric submersible artificial lift system comprises:

receiving a fishing tool by the electric submersible artificial lift system.

10. The method of claim 9, further comprising over-pulling or jarring the electric submersible artificial lift system by the fishing tool, the latch releasing the electric submersible artificial lift system responsive to the over-pull or jar.

11. The method of claim 9, further comprising over-pulling or jarring the electric submersible artificial lift system by the fishing tool, the latch releasing the electric submersible artificial lift system responsive to the over-pull or jar and leaving the safety valve within the wellbore with the packer.

12. A wellbore system comprising:

a cable extending into a wellbore from a topside facility, the cable comprising electrical lines, hydraulic lines, and a support structure configured to support tooling at a downhole end of the cable;

an electric submersible artificial lift system at the downhole end of the cable, the electric submersible artificial lift system comprising:

an electric motor;

a fluid end coupled to and configured to be driven by the electric motor; and a shear interconnect at an uphole end of the electric submersible artificial lift system, the shear interconnect configured to shear the cable between the electric submersible artificial lift system and the topside facility, the shear interconnect configured to shear the cable at the electric submersible artificial lift system;

a packer defining a receptacle configured to receive the electric submersible artificial lift system;

a safety valve arranged to cease flow within the wellbore when the safety valve is in a closed position; and a mechanical shifting tool configured to actuate an isolation barrier within the receptacle, the isolation barrier biased towards a closed position, the mechanical shifting tool configured to move the isolation barrier to an open position once the electric submersible artificial lift system and safety valve are received by the receptacle.

13. A wellbore system comprising:

a cable extending into a wellbore from a topside facility, the cable comprising electrical lines, hydraulic lines, and a support structure configured to support tooling at a downhole end of the cable;

an electric submersible artificial lift system at the downhole end of the cable, the electric submersible artificial lift system comprising:

an electric motor;

a fluid end coupled to and configured to be driven by the electric motor; and a shear interconnect at an uphole end of the electric submersible artificial lift system, the shear interconnect configured to shear the cable between the electric submersible artificial lift system and the topside facility, the shear interconnect configured to shear the cable at the electric submersible artificial lift system;

a packer defining a receptacle configured to receive the electric submersible artificial lift system;

a safety valve arranged to cease flow within the wellbore when the safety valve is in a closed position; and a pressurized canister, the pressurized canister configured to provide pressure to the safety valve to reduce a force needed to actuate the safety valve.

14. A method of using the wellbore system of claim 13, comprising:

supporting, by the cable extending into the wellbore from the topside facility, the electric submersible artificial lift system;

receiving the electric submersible artificial lift system by the packer;

providing pressure to the safety salve, the pressure reducing a force needed to actuate the safety valve;

actuating, by the hydraulic lines, the safety valve;

injecting, by the hydraulic lines, chemicals into a production stream; and shearing, by the shear interconnect, the cable at the electric submersible artificial lift system.

* * * * *